US005142960A

United States Patent [19]

Iwase et al.

[11] Patent Number: 5,142,960

[45] Date of Patent: Sep. 1, 1992

[54] ELECTRONIC MUSICAL INSTRUMENT WITH AUTOMATIC CONTROL OF MELODY TONE IN ACCORDANCE WITH MUSICAL STYLE AS WELL AS TONE COLOR

[75] Inventors: Fumio Iwase; Kotaro Mizuno, both of Hamamatsu, Japan

[73] Assignee: Yamaha Corporation, Hamamatsu, Japan

[21] Appl. No.: 537,650

[22] Filed: Jun. 14, 1990

[30] Foreign Application Priority Data

Jun. 15, 1989 [JP] Japan ..... 1-69947[U]

[51] Int. Cl.[5] ..... G10H 5/00; G10H 1/02

[52] U.S. Cl. ..... 84/662; 84/626

[58] Field of Search ..... 84/622, 626, 628, 658, 84/659, 662, 704, 600, 615, 627, 663, 701

[56] References Cited

U.S. PATENT DOCUMENTS

| | | | |
|---|---|---|---|
| 4,332,183 | 6/1982 | Deutsch | 84/627 |
| 4,655,114 | 4/1987 | Sunada | 84/626 |
| 4,699,037 | 10/1987 | Minamitaka et al. | 84/658 |
| 4,726,276 | 2/1988 | Katoh et al. | 84/1.19 |
| 4,920,851 | 5/1990 | Abe | 84/626 |

*Primary Examiner*—William M. Shoop, Jr.
*Assistant Examiner*—Jeffrey W. Donels
*Attorney, Agent, or Firm*—Spensley Horn Jubas & Lubitz

[57] ABSTRACT

An electronic musical instrument is provided with tone color specifying switch, musical style specifying switch and device for deciding the joint of melody tones based on the tone color and musical style specified by these switches. A new-timing melody tone is decided to be jointed with a preceding timing melody tone, based on the specified tone color and musical style, in the state of melody tone joint, for example legato state or nonlegato state, during the preceding timing melody tone is being generated.

8 Claims, 9 Drawing Sheets

| Style No. | Style name | Melody tone color | Legato effect | Additive tone |
|---|---|---|---|---|
| 1 | Jazz, warts | Flute | o | Flute harmony |
| 2 | Baroque | Flute | x | Harpsichord pattern |
| 3 | Hard rock | Electric guitar | o | Guitar pattern |
| 4 | Country | Banjo | x | Banjo pattern |
| 5 | Pops | Piano | x | Piano pattern |

| Style No. | Style name | Melody tone color | Legato effect | Additive tone |
|---|---|---|---|---|
| 1 | Jazz, warts | Flute | o | Flute harmony |
| 2 | Baroque | Flute | x | Harpsichord pattern |
| 3 | Hard rock | Electric guitar | o | Guitar pattern |
| 4 | Country | Banjo | x | Banjo pattern |
| 5 | Pops | Piano | x | Piano pattern |

Fig. 2

ELECTRONIC MUSICAL INSTRUMENT WITH AUTOMATIC CONTROL OF MELODY TONE IN ACCORDANCE WITH MUSICAL STYLE AS WELL AS TONE COLOR

FIELD OF THE INVENTION

This invention relates to an electronic musical instrument capable of controlling automatically the joint of melody tone according to style of melody to be played.

DESCRIPTION OF THE PRIOR ART

The currently available electronic musical instrument which is designed to play melody by using the melody playing means such as melody key or the like features that melody is controlled by the tone joint of legato system or nonlegato system. Generally, the musical tone has an overshoot part (attack part) 101 at the initial stage of tone generation as shown by the envelope waveform at the left side of FIG. 4 (A) and a release part 102 where musical tone is cleared. The nonlegato system features that when musical tones are played continuously, an attack part and a release part are provided for each musical tone. The legato system features that the release part of preceding musical tone and the attack part of following musical tone are not provided so that two musical tones are joined smoothly.

Until now, in most cases switching of legato system and nonlegato system is executed depending on specific tone color. For example, when musical tone of percussion instrument or piano is played, the nonlegato system is preferred, but when musical tone of stringed instrument or wind instrument is played, the legato system is preferred. An electronic musical instrument designed to judge the legato system and nonlegato system (whether or not the legato effect is given) according to the key pressing time for one musical tone has been also proposed (an example is Japanese Patent Application Publication No. sho. 62-48833).

However, the switching method designed to change the legato system and nonlegato system according to the key pressing time for one musical tone has a defect that giving/nongiving of legato effect is decided depending on music tempo. A method to memorize beforehand giving/nongiving of legato effect has been also proposed (an example is Japanese Patent Application laid open No. sho. 63-291095). There are no practically available means for automatically deciding the legato system and nonlegato system when player is playing music.

SUMMARY OF THE INVENTION

It is therefore an object of the present invention to provide an electronic musical instrument in which the above-mentioned problems have been solved by deciding giving/nongiving of legato effect based o the style which decides the general atmosphere of music.

In accordance with the invention the electronic musical instrument decides the melody tone joint based on the specifications of color tone specifying means and style specifying means. Variation of level and pitch at a position where one musical tone is changed to another musical tone such as legato, nonlegato and portamento is referred to as tone joint. The music style means style (or genre or manner of execution), of music such as Pops, baroque, jazz, etc. Since the playing system and music atmosphere are generally decided by music style, it is possible to express the musical tone suited to specific music.

BRIEF DESCRIPTION OF THE DRAWINGS

FIG. 2 shows the style table which is set in the pattern memory of the above mentioned control section.

FIG. 4 (B) shows the musical tone envelope waveform in legato mode.

DESCRIPTION OF THE PREFERRED EMBODIMENT

Figure 1:
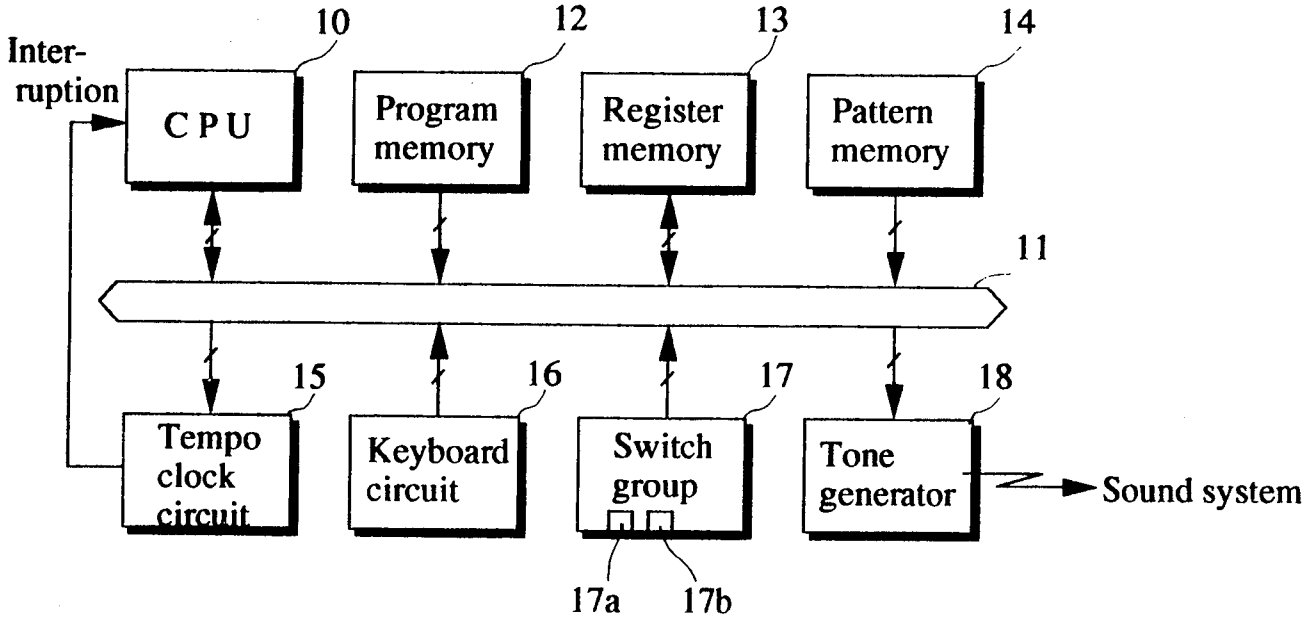
FIG. 1 is a block diagram showing the control section of an electronic musical instrument which is an example of an embodiment of the invention.

FIG. 1 is a block diagram of an electronic musical instrument which is an example of embodiment of the invention. This electronic musical instrument has a solo-style play mode. It is designed so that when melody is played in this mode, legato or nonlegato is automatically selected according to the style of music to be played.

This electronic musical instrument is controlled by CPU 10. CPU 10 is connected to another device through a bus 11. This device comprises program memory 12, register memory 13, pattern memory 14, tempo clock circuit 15, keyboard circuit 16, switch group 17 and tone generator 18. The program expressed as a flow chart shown in FIG. 3 (A) to (D) is stored in the program memory 12. The register group designated to store key-on data and the like is set in the register memory 13. The table shown in FIG. 2 is set in the pattern memory 14. The tempo clock circuit 15 is a circuit for generating clock pulses with a tempo which is set by CPU 10. The CPU 10 receives the generated clock pulse as an interrupt signal. The keyboard circuit 16 is a circuit to monitor the melody keyboard (melody key) and accompaniment keyboard (accompaniment key). It detects key ON/OFF and key touch intensity when the key is turned on. The switch group 17 includes the tone color setting switch, the mode setting switch (solo style play switch 17*a*) and the music style setting switch (solo style selector 17*b*). The tone generator 18 contains the tone generating circuit for 0 to 3 channels. It can generate the additive tones f or accompaniment in addition to melody.

FIG. 2 shows a style table set in the pattern memory 14. The optimum tone color, giving/nongiving of legato effect, tone color of additive tone and pattern are stored in this style table for each music style (jazz, waltz, baroque, etc.). The legato effect is changed if the style is changed although the color tone is the same. Except for tone color of melody which is decided according to this table, the player can originally decide the tone color.

Figure 3:
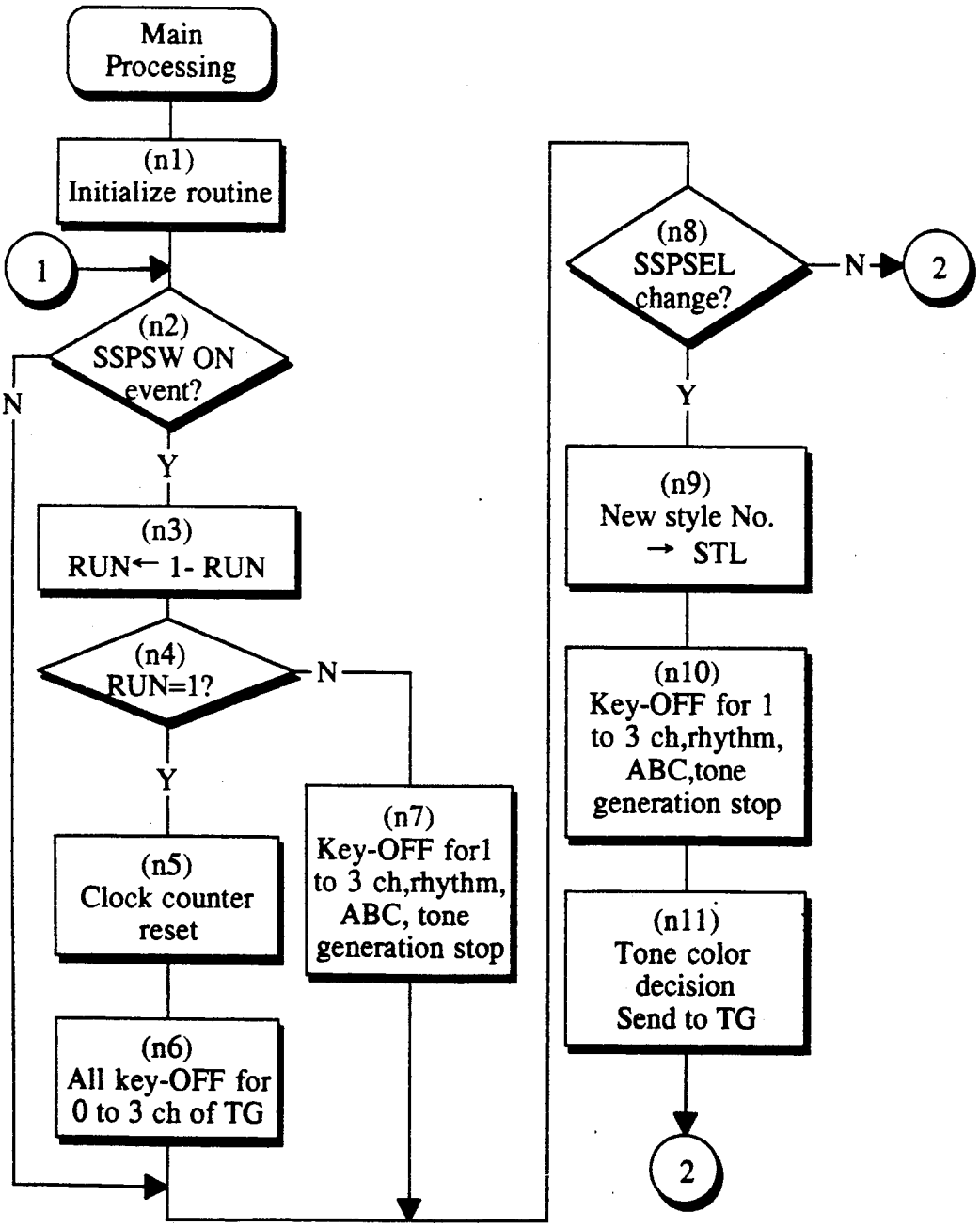
FIGS. 3 (A) to (D) show the flow charts of the control section.
Figure 3:
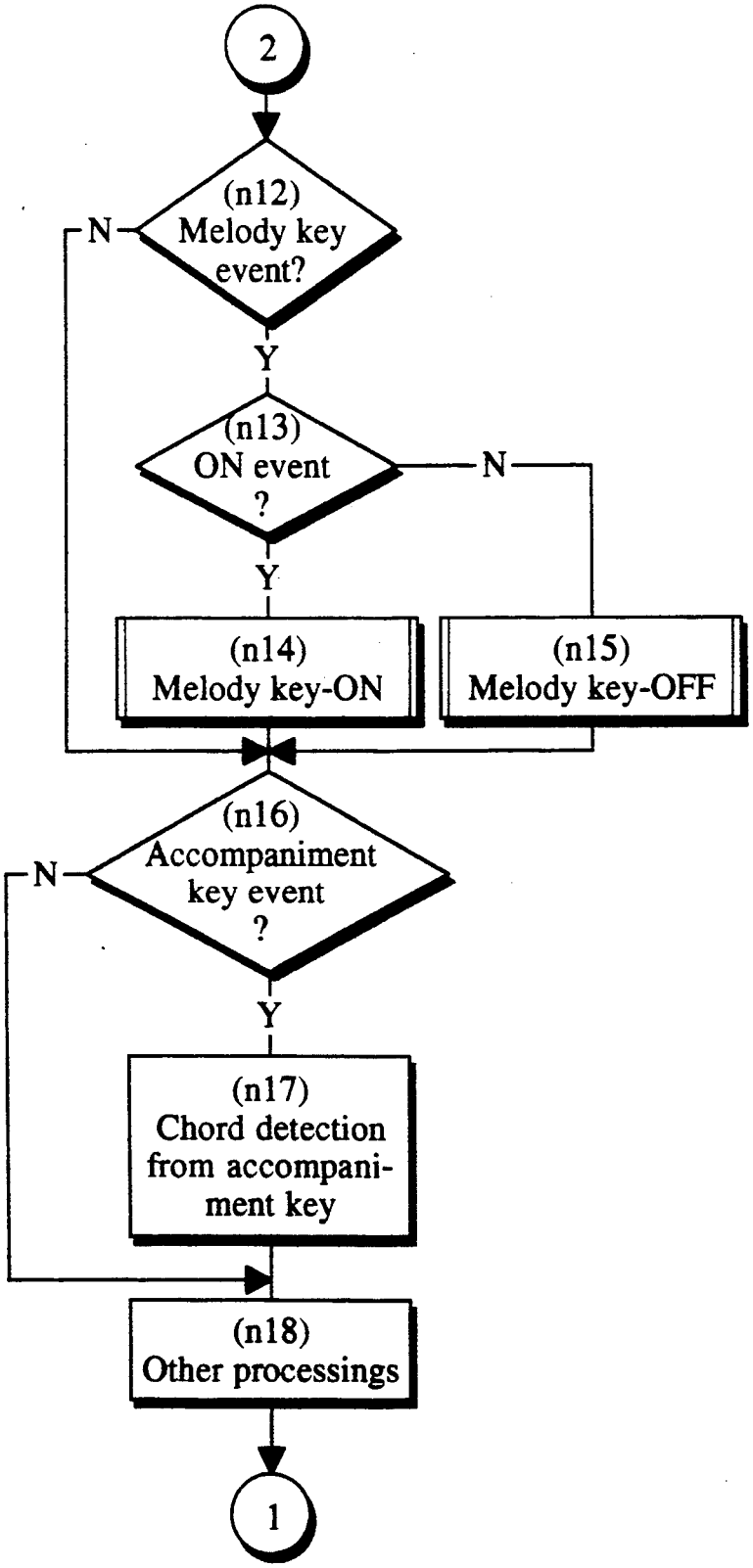
Figure 3:
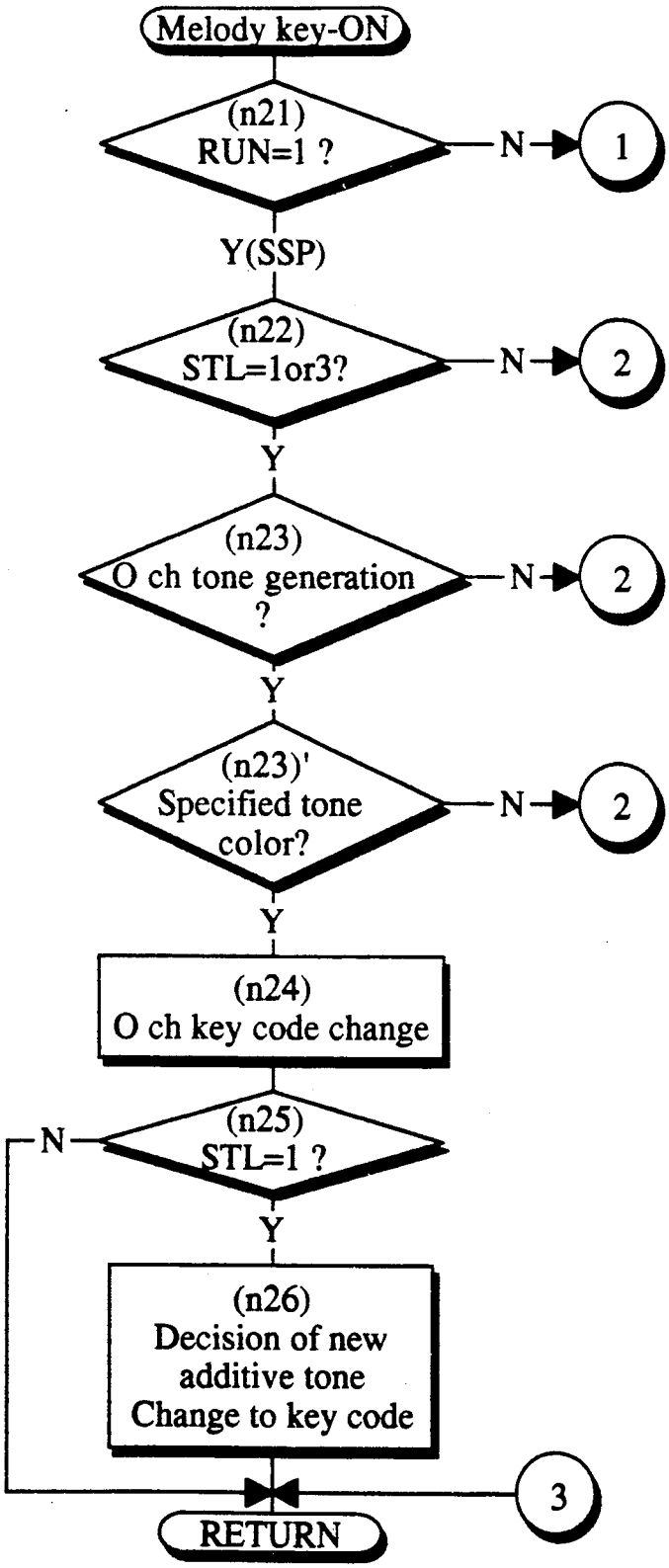
Figure 3:
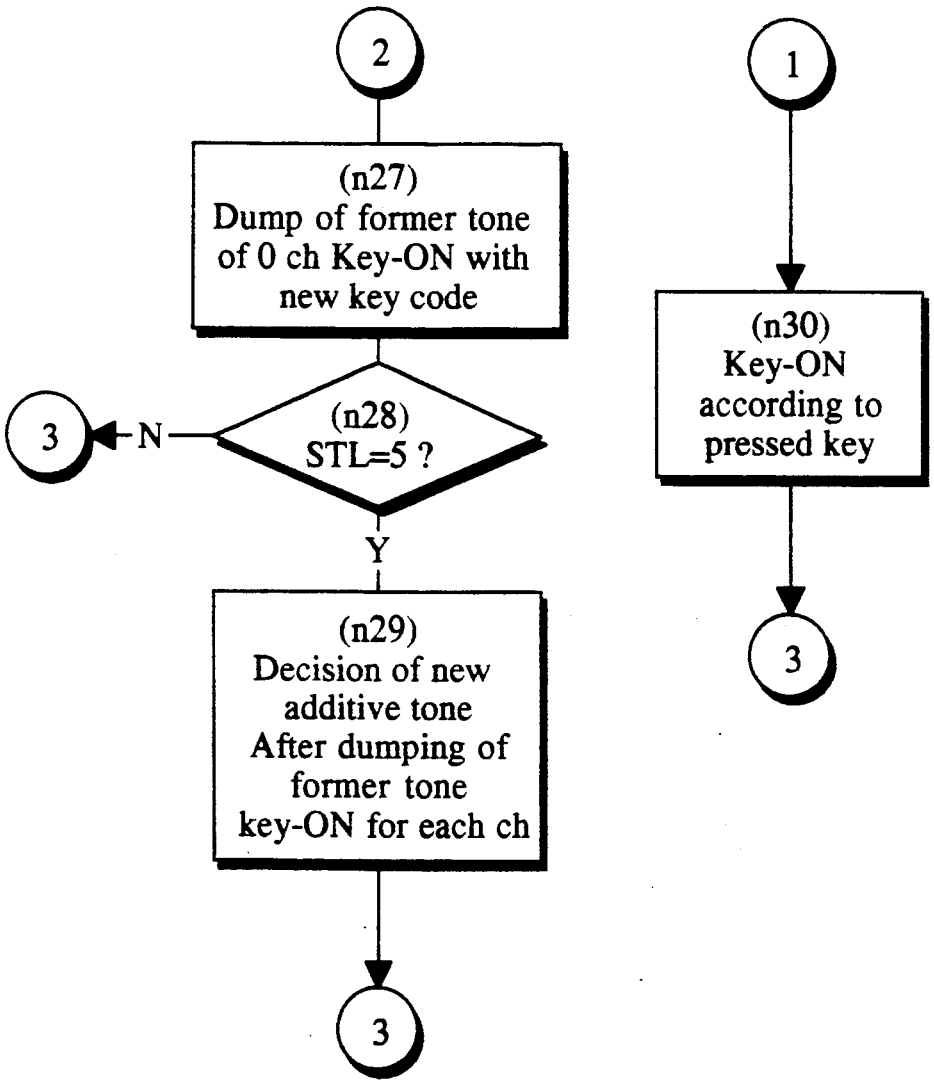
Figure 3:
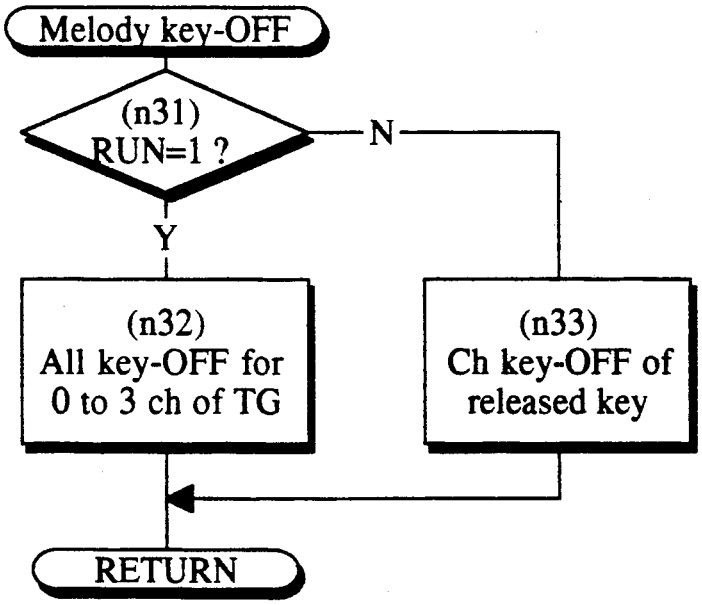
Figure 3:
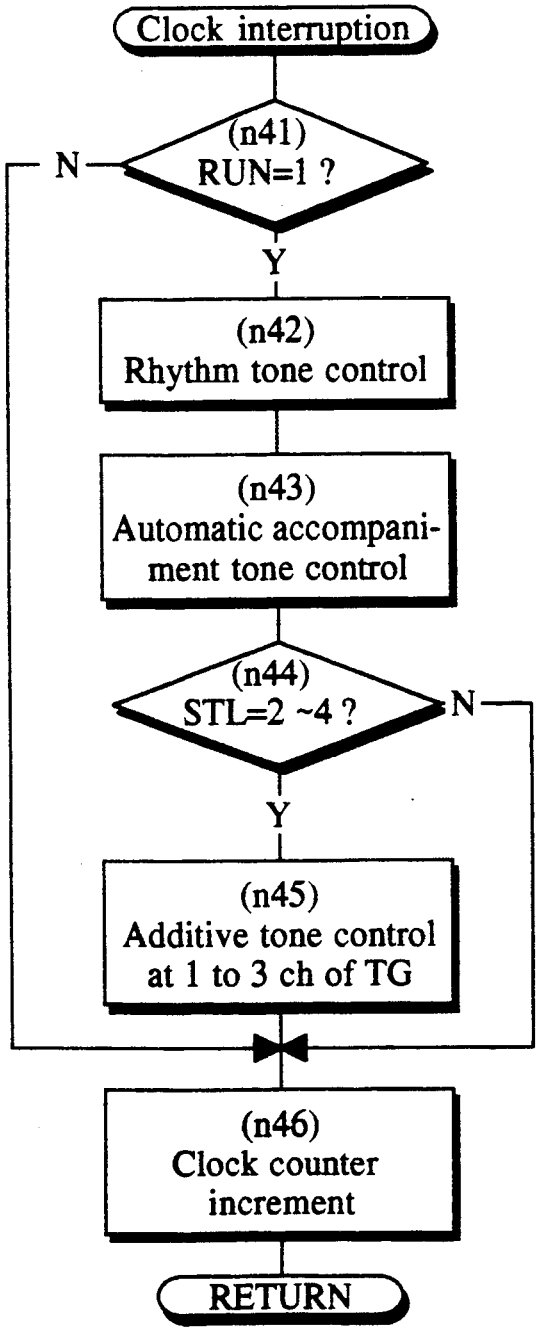
Figure 4:
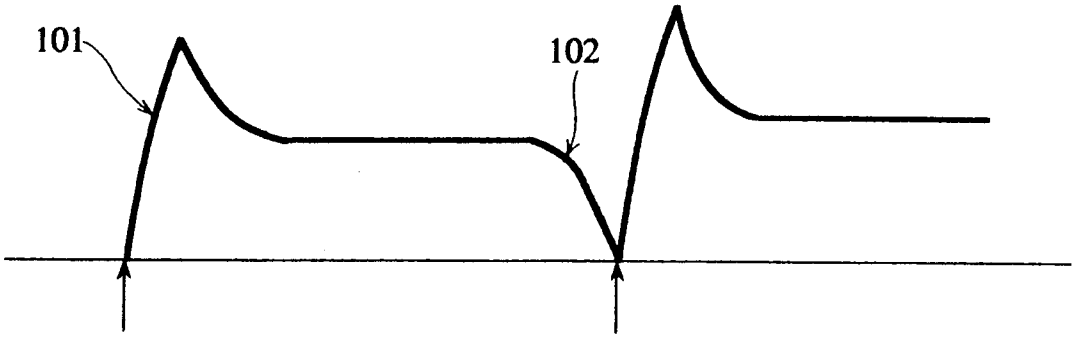
FIG. 4 (A) shows the musical tone envelope waveform in nonlegato mode.
Figure 4:
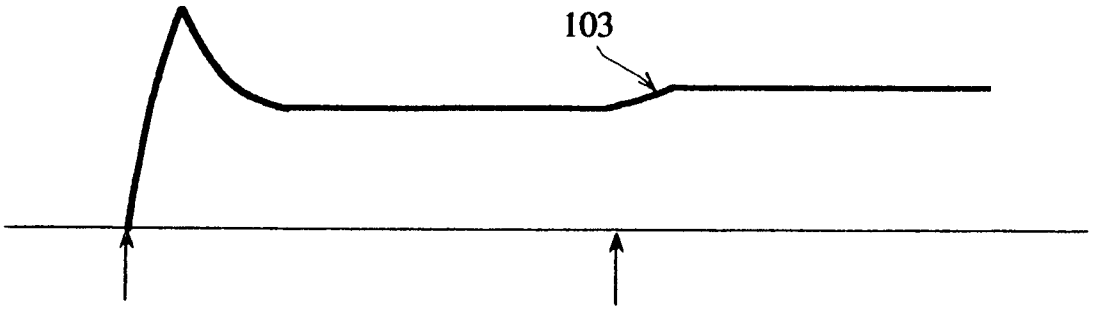

FIGS. 3 (A) to (D) are flow charts showing the operations of above-mentioned CPU 10. FIG. 3 (A)-1 and (A)-2 shows a main routine. When power supply of this electronic music instrument is turned on, CPU 10 executes initialization, resulting in clearing of registers (m). As a result of this operation the electronic music instrument becomes operable. Next, at steps n2, n8, n12 and n16 ON/OFF event of solo style play switch (SSPSW) 17*a*, solo style play selector (SSPSEL) 17*b*, melody and accompaniment key is detected. In usual state this detection operation and other processings such as tone volume control at step n18 are performed repeatedly. When ON event of solo style play switch 17*a* is detected at step n2, operations of steps n3 to n7 are executed. At step n3 the RUN flag indicating the solo style play mode is inverted. If the flag is set as a result of inversion, the solo style play mode is set. In this case the process proceeds from step n4 to n5, the clock counter is reset (n5), and the tone generation circuit for channels 0 to 3 of tone generator 18 is wholly set to OFF. If the RUN flag is reset as a result of its inversion, key-off operation is performed for channels 1 to 3 of tone generator 18 so that generation of rhythm and bass tone is stopped (n7).

If change of style name specified by the solo style play selector 17*b* is detected at step n8, the operations of steps n9 to n11 are executed. At step n9 a new style number is set in the STL register. The above-mentioned style table is retrieved based on the number which has been set in this STL register, and pertinent data such as relevant style name is read. At step n10 the accompaniment tone which was being generated until now is stopped at step n10, and at step n11 the melody tone color information corresponding to the above-mentioned read out style name is sent to a tone generator 18.

When melody key ON/OFF is detected at step n12, a judgment as to whether the current event is ON event or OFF event is performed at step n13. If the current event is ON event, a melody key ON subroutine (n14) is executed. If the current event is OFF event, a melody key OFF subroutine (n15) is performed. If accompaniment key ON/OFF is judged at step n16, at step n17 the type and root of chord are judged from the combination of accompaniment keys pressed at this time, and a tone is set as an additive tone.

FIG. 3 (B) 1 and 2 shows a melody key ON subroutine. When a melody key is turned on, this subroutine is started. At first, at step n21 a judgment as to whether the RUN flag has been set or not is performed. If the RUN flag has been set, the current mode is solo style play mode. In this case the operations of step n22 and on are executed. If the RUN flag has been reset, only ordinary tone generation is specified. Therefore, the process proceeds to step n30. An empty channel is selected from channels 0 to 3 of tone generation circuit according to the key code of turned on key, the specific key code is assigned to this channel, and this key code is sent to the tone generator. At step n22 a judgment as to whether the set data of STL register is 1 or 3 is performed. If STL is 1 or 3, the legato effect is added. If the legato effect is added, the process proceeds to n23. If the legato effect is not added, the process proceeds to n27. At step n23 a judgment, as to whether or not the 0 channel is generating tone at present, is performed. At step n23, a judgment, as to whether or not the tone color of the channel 0 is at present tone color specified in the table of FIG. 2, is performed. If it is not a specified tone color, the process proceeds to step n27 so as to add an attack to form the regular tone color waveform. If tone of channel 0 is being generated and it is the specified tone color, legato processing is performed. In this case only the key code is changed at step n24. Change of only key code gives the legato effect. If the preceding musical tone has already been cleared even when the legato effect is given, the process proceeds from n23, to n27 to perform the regular tone generation processing having an attack since this process is generation of new musical tone. At step n24 only the key code of channel 0 of the tone generator is changed to the newly specified one. As a result the musical tone which was being generated until the present is free of release section, and a new musical tone free of attack section is generated soon. Accordingly, at a joint of two musical tones only the pitch is transferred. Then, at step n25 a judgment as to whether the STL register is 1 or not is performed. If STL is 1, a new additive tone is decided based on the key code of newly pressed key. Thus specified additive tones are changed to key codes, and these key codes are set to channels 1 to 3, and the process returns. If in this case the new and old additive tones have the same pitch, tone generation is continued without giving any attack. On the other hand, at step n27, if tone of channel 0 is being generated at present, this tone is forcibly dumped, and the musical tone of new key code is subjected to key-on processing with an attack. Next at step n28 a judgment, as to whether STL is 5 or not, is performed. If STL is 5, the additive tone is piano harmony (organ point of chord) (see FIG. 2). In this case the chord is judged based on new keying, and a new additive tone is decided according to this chord. After the old tone is dumped, harmony starts with a new additive tone (n29). After that the process returns.

FIG. 3 (C) shows a melody key-off subroutine. When the melody key is set to OFF, SET/RESET of RUN flag is judged at step n31. If the RUN flag has been set, musical tones of all channels (0 to 3) of tone generator are stopped. This is due to the fact that in solo style play mode the generation/stop of all musical tones is controlled by ON/OFF of melody key on channel 0. If the RUN flag has been reset, a channel, where musical tone of the key which is set to OFF is generated, is retrieved from channels 0 to 3, and only the pertinent channel is subjected to key-off processing, and then the process returns (n33).

FIG. 3 (D) shows clock interrupt operation. This operation is executed in CPU 10 according to the interrupt signal of tempo clock circuit 15. Clock interrupt becomes valid only when the solo style play mode has been set. Therefore if the RUN flag has been reset when it is referenced at step n41, the process returns. If the RUN flag has been set, the rhythm tone control (n42) and automatic accompaniment tone control (n43) are executed according to the clock information. Then at step n44 the data of STL register is judged. If data of STL register is 2, 3 or 4, the specified additive tone addition system is pattern type (for example, if STL = 3, guitar pattern), a tone to be added with specific timing is sent to the channel 1 to 3 so that the additive tone is generated (n45). If data (style number) of STL register is 1, the additive tone is harmonic. Therefore in this case control is not affected by clock interrupt. Then, the clock counter increments (n46), and the process returns.

In the above mentioned example the envelope waveforms of musical tones in the solo style play mode are joined smoothly. It is also possible to apply portamento by smoothing also the pitch displacement.

What is claimed is:

1. An electronic musical instrument, comprising:

melody playing means for performing a melody playing operation;

tone color specifying means for specifying a selected tone color;

musical style specifying means for specifying a selected musical style denoting a manner of execution of the melody playing means in performing a melody playing operation; and legato deciding means for selectively employing a legato effect in the performing of a melody playing operation by the melody playing means based on the tone color specified by the tone color specifying means and the musical style specified by the musical style specifying means.

2. The electronic musical instrument according to claim (1), wherein said melody playing means comprises a keyboard.

3. The electronic musical instrument according to claim (1), wherein said legato deciding means is operative to select the employment or nonemployment of a legato effect to each musical tone.

4. The electronic musical instrument according to claim (1), wherein the musical style represents an attribute of a melody playing operation.

5. The electronic musical instrument according to claim (1), wherein the musical style represents a musical type that is determined by a performance pattern and a combination of tone colors.

6. The electronic musical instrument according to claim (1), wherein the selected musical style is determined by an optimum tone color, a legato effect, a tone color of an additive tone and a performance pattern.

7. A method for performing a melody playing operation with an electrical musical instrument, comprising steps of:

specifying a musical style to be performed, the style representing a musical type that is determined by a performance pattern and a combination of tone colors;

performing a melody tone;

choosing a new melody tone to be performed during the performing of a preceding melody tone; and connecting said preceding melody tone and said new melody tone with employment or nonemployment of a legato effect in accordance with the specified musical style when performing a melody tone.

8. The method according to claim 7, wherein the step of specifying a musical style to be performed includes the steps of:

determining an optimum tone color;

determining a legato effect;

determining a tone color of an additive tone; and determining a performance pattern.

* * * * *